United States Patent [19]

Gamberini

[11] Patent Number: 4,861,415

[45] Date of Patent: Aug. 29, 1989

[54] MACHINE FOR MOISTENING A COVER TO BE FIXED ONTO A BASE FILLED FOR EXAMPLE WITH A PHARMACEUTICAL PRODUCT

[75] Inventor: Ernesto Gamberini, Rostignano-Pianoro, Italy

[73] Assignee: MG 2 S.p.A., Italy

[21] Appl. No.: 184,967

[22] Filed: Apr. 22, 1988

[30] Foreign Application Priority Data

Apr. 27, 1987 [IT] Italy ..... 3448 A/87

[51] Int. Cl.[4] ..... B65B 51/02

[52] U.S. Cl. ..... 156/556; 53/900; 156/69; 156/566; 156/578

[58] Field of Search ..... 156/556, 69, 578, 566; 53/900, 471, 282, 383

[56] References Cited

U.S. PATENT DOCUMENTS

| | | | |
|---|---|---|---|
| 3,078,629 | 2/1963 | Besemer et al. | 53/900 X |
| 4,403,461 | 9/1983 | Goutard et al. | 53/900 X |
| 4,756,902 | 7/1988 | Harvey et al. | 53/900 X |

*Primary Examiner*—David Simmons

*Attorney, Agent, or Firm*—Kane, Dalsimer, Sullivan, Kurucz, Levy, Eisele and Richard

[57] ABSTRACT

A machine moistens a cover of a capsule for pharmaceutical products and includes a supply hopper for these covers. The supply hopper has an outlet opening with withdrawal means operable to withdraw the covers from the supply hopper through this opening. Moistening means moistens, with a sealing liquid the rim of each cover located on the withdrawal means. The withdrawal means includes a first disc mounted for rotation about axes transverse to another. A plurality of withdrawal devices and moistening devices are carried by the first disc.

25 Claims, 4 Drawing Sheets

MACHINE FOR MOISTENING A COVER TO BE FIXED ONTO A BASE FILLED FOR EXAMPLE WITH A PHARMACEUTICAL PRODUCT

BACKGROUND OF THE INVENTION

The present invention relates to a machine for moistening a cover to be fixed onto a base filled for example with a pharmaceutical product.

As is known, groups of machines are currently commercially available which separate a cover from its base, deliver into the interior of the base a metered quantity of one or more products, and re-close the cover onto the corresponding base. The cover force-fitted onto its base for closure thereof by suitably predetermining the inner diameter of the cover and the outer diameter of the base.

These groups of machines are further provided with a machine which, after separation of the cover from its base, retains the cover until the corresponding base has travelled, for example along a conveyor belt, through all the machines of the group. Subsequently the cover is released to a closure machine which acts to close the cover onto the corresponding base in the same relative angular position which these elements had before their separation.

The above-described groups of machines are of high cost above all because of the large number of machines necessary for the orientation and separation of the cover from its base, and for guaranteeing the closure of the cover onto the corresponding base. Moreover, currently materials for the cover and the base which do not support closure by means of force-fitting are becoming more widespread.

SUMMARY OF THE INVENTION

The object of the present invention is that of providing a machine for moistening a cover to be fixed onto a base filled for example with a pharmaceutical product, which is of reduced production cost.

According to the present invention there is provided a machine for moistening a cover to be fixed onto a base filled for example with a pharmaceutical product, characterised by the fact that it comprises first means rotating about a machine axis and operable to withdraw the said cover from a feed outlet of a hopper, and second means operable to moisten a rim of the said cover carried by the said first means, with a liquid which permits sealing of the said cover onto the said base.

BRIEF DESCRIPTION OF THE DRAWINGS

For a better understanding of the present invention an embodiment is now described, purely by way of non-limitative example, with reference to the attached drawings, in which.

DETAILED DESCRIPTION OF THE INVENTION

Figures 1A, 1B:
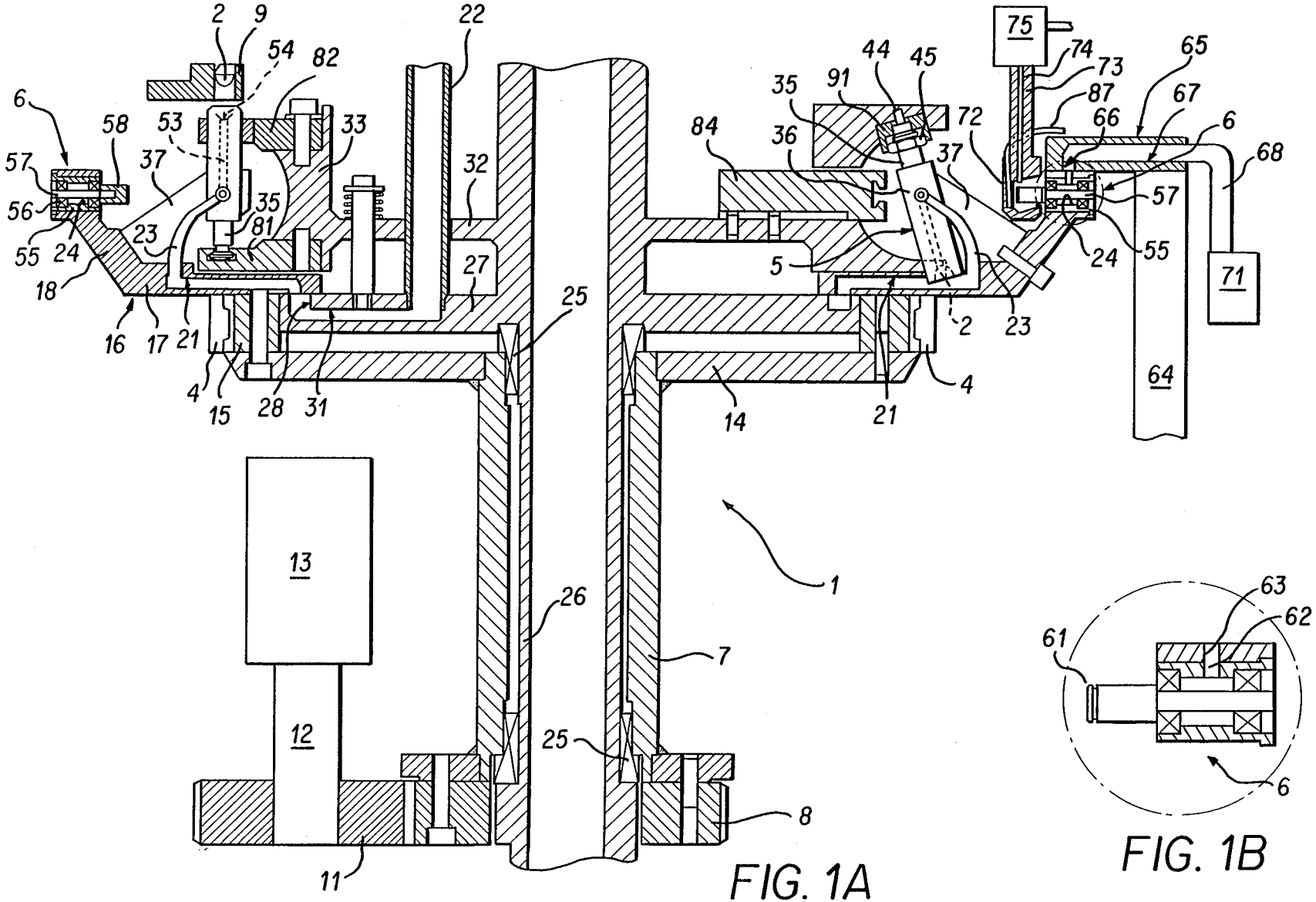
FIG. 1 is a partial view in section of a machine formed according to the principles of the present invention.

As illustrated in FIG. 1, a machine for moistening a cover 2 to be sealed onto a base 3 filled for example with a pharmaceutical product is generally indicated with the reference numeral 1. The machine 1 forms part of a group of machines including a machine for supplying bases 3 and one or more filling machines. The group is traversed by a conveyor belt of known type having a plurality of sockets 4 in which sealing of the covers 2 onto respective bases 3 takes place. The machine 1 includes a hopper (not illustrated because it is of known type) supplied with covers 2 and provided with a known device for orientation of the covers 2, and a plurality of devices 5 acting to withdraw a respective cover 2 from an outlet opening 9 of the hopper, to carry it to a respective moistening device 6, and then to deliver it into the interior of one of the sockets 4 for sealing onto one of the bases 3.

The machine 1 includes a hollow rotating shaft 7 which carries at its lower end a toothed wheel 8 meshing with a toothed wheel 11 fitted onto an output shaft 12 of an electric motor 13. Since the machine 1 is part of a group of machines in each of which there are rotating members, rotation of the shaft 7 can be effected alternatively by an electric motor responsible, via reduction gears or pulleys, also for the rotation of all the rotating members present in the group. It is also possible that rotating parts of the machines of the group are toothed for meshing with one another in such a way that a rotating part of one machine connected to an electric motor can drive all the rotating parts of the other machines of the group. The shaft 7 has its longitudinal axis vertical and this axis constitutes the machine axis.

At the upper end of the shaft 7 there is, coaxially, a rotatable disc 14 fixed to the shaft and along the perimetral edge of which is fixed, coaxially, a rotating annular element 15 the outer lateral surface of which is shaped in a known way such as to be engaged by the said conveyor belt. Coaxially above the element 15 and fixed to this is a rotating disc 16 which supports and therefore carries into rotation the said plurality of devices 5 and 6 which are equal to number to one another in that each device 5 has an associated device 6. The disc 16 is cup-shape and thus has a flat portion 17 parallel to the disc 14 and a frustoconical portion 18. In the flat portion 17 there is formed a plurality of radial holes 21 the underside of each of which communicates, by means of elements which will be described hereinbelow, and in a way which is also described hereinbelow, with the tubular terminal part 22 of an air suction installation. Each radial hole 21 communicates by means of a respective duct 23, with an inner part of a corresponding device 5. The frustoconical portion 18 supports the devices 5 by means of a plurality of forks so that these in use are driven to rotate by the portion 18 and at the same time rotate about the pivot axis with the fork by the action of a member which will be described hereinbelow. The portion 18 has in its upper part a plurality of radial through holes 24 the longitudinal axes of which are horizontal and in particular radial with respect to the axis of the rotating shaft 7. The holes 24 house respective devices 6.

With reference to FIG. 1, within the rotatable shaft 7 is installed, with the interposition of two thrust bearings 25, a fixed shaft 26 which extends upwardly beyond the upper end of the shaft 7 and supports, in a manner not illustrated, the said hopper and all the fixed parts which will be described hereinbelow. At the same level as the element 15, the element 16 coaxially supports a fixed disc 27 along the upper face of which, in correspondence with the lower opening of the holes 21, is formed an upwardly open slot 28 and from the lower part of which extends a horizontal radial hole 31 which puts the slot 28 and therefore the holes 21 facing this latter into communication with the tube 22 which is fitted onto the disc 27 in correspondence with the inner end of the hole 31. It is to be noted, also with reference to FIGS. 4 and 5, that the slot 28 has a longitudinal axis which describes a wide arc of a circle coaxial with the shaft 7 so that a good part of the holes 21 are in communication with the suction system. Above and parallel to the disc 27 a plate 32 extends coaxially from the shaft 26, along the perimetral edge of which is formed an annular body 33 which, as will be better seen hereinbelow, supports a series of cams responsible for the rotation of the devices 5 about their pivot axes with the respective forks.

Figure 2A:
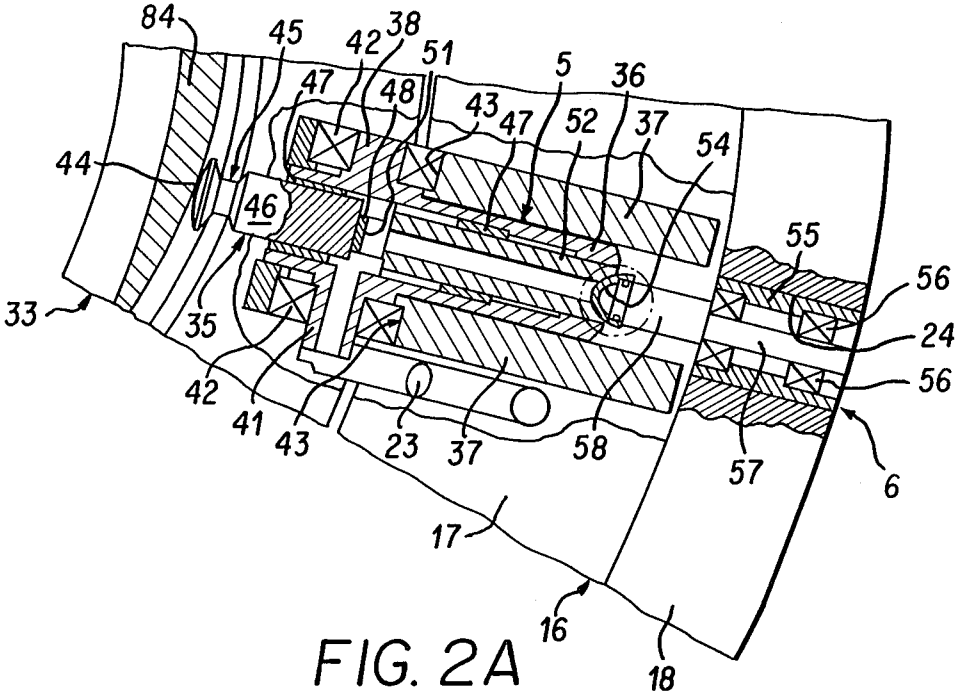
Figure 2B:
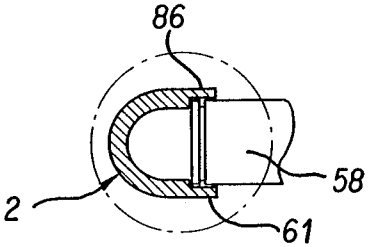

With reference to the attached drawings, each device 5 comprises a piston 35 axially slidable within a hollow cylinder 36 which is pivoted to two arms 37 of a respective fork. In particular, from the cylinder 36 two coaxial cylindrical projections 38 and 41 extend radially outwardly. The projection 38 is solid, whilst the projection 41 is axially pierced and at its end is fixed one end of the duct 23. The projections 38 and 41 rest, with the interposition of a respective bearing 42, within a respective hole 31 formed in the arms 37 of the corresponding support fork. The cylinder 36 can therefore rotate, also driving the piston 35 into rotation about the axis of the projections 38 and 41. The piston 35 has, in succession, a head 44 suitably shaped to cooperate with cams carried and defined within the body 33, an annular groove 45, a solid portion 46 a part of which remains within the interior of the cylinder 36 with the interposition of a bush 47 (FIG. 2), a central portion 48 of small diameter and longitudinal extent and having a diametral through hole 51, and a portion 52 having an axial through hole 53, which extends within the cylinder 36 from the hole 51 with the interposition of a second bush 47. The head 44, the groove 45 and a part of the portion 46 lie outside the cylinder 36. The hole 51 is at the same level as the inner hole of the projection 41 and because of the diametral dimensions of the portion 48 is able to put the duct 23 in pneumatic communication with the hole 53 of the portion 52 the free end of which is suitably shaped in such a way as to define a seat 54 for receiving a cover 2.

As illustrated in the attached drawings, each device 6 includes a hollow cylinder 55 within which a rotating spindle 57 is freely mounted, with the interposition of two bearings 56; one end of the rotating spindle 57, which projects from the cylinder 55, coaxially supports a cylindrical body 58 at the free end of which is formed an annular groove 61. The cylinder 55 is fixed in that it is rigidly housed within the interior of one of the holes 24 and has a radial through hole 62 coaxial with a through hole 63 formed at the free end of the portion 18. The machine 1 includes a fixed column 64 which at the top supports a plate 65 which in plan describes a circumferential sector and which has, along a part of its lower face positioned above the free end of the portion 18, a downwardly open slot 66 and which is in communication, because it faces the hole 63, with the internal space within the device 6 defined between the inner part of the cylinder 55 and the shaft 57. In the plate 65 is formed a radial hole 67 which extends from the slot 66 and which has an opening to receive the end of a duct 68 which extends from a compressed air source 71 illustrated schematically in FIG. 1.

With reference to FIG. 1, the machine 1 includes a fixed body 72 the longitudinal axis of which describes an arc of a circle coaxial with the shaft 7 and which is C-shape in transverse section. In use the cylindrical body 58, which as has been indicated has a horizontal axis, during its rotation about the axis of the shaft 7 traverses through the interior of the body 72 which supports at its top a vertical rod 73 which houses within it a needle 74 constantly able to receive, via a metering pump 75 installed above, a liquid which will be described hereinbelow and able to allow drops of this liquid to fall from its end within the body 72 onto the body 58 in correspondence with the annular groove 61.

Figure 4:
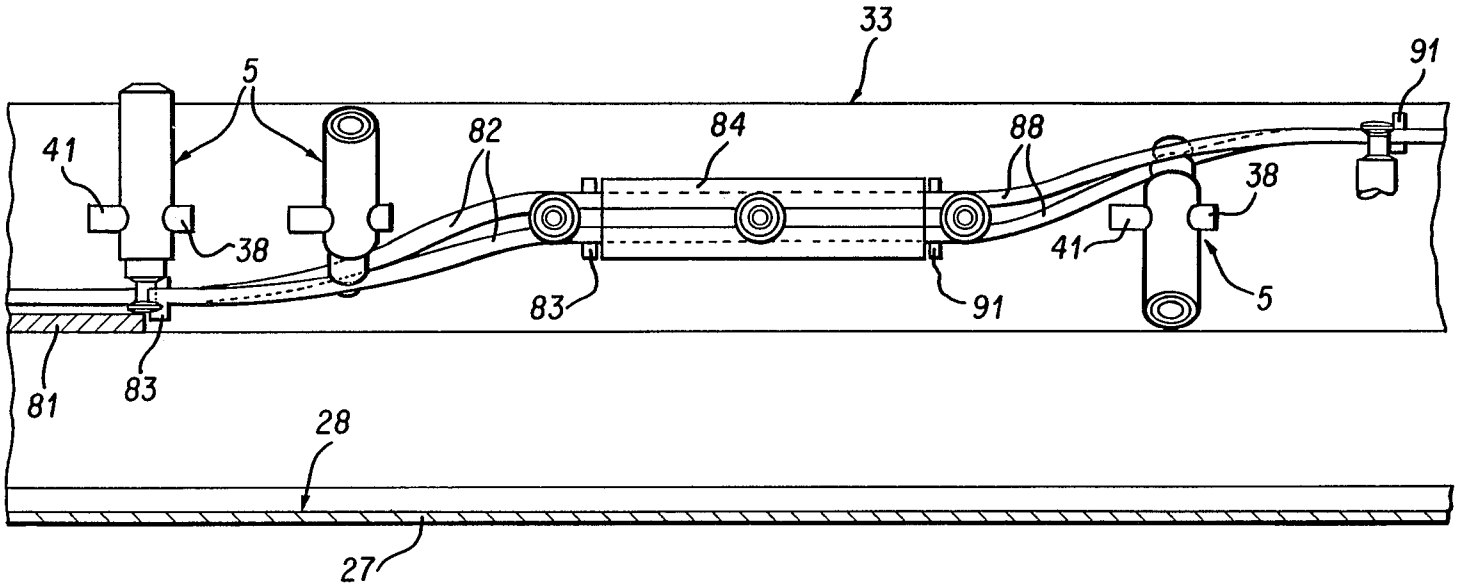
FIGS. 4 and 5 are views which illustrate the various operating phases of the detail of FIG. 2.
Figure 5A:
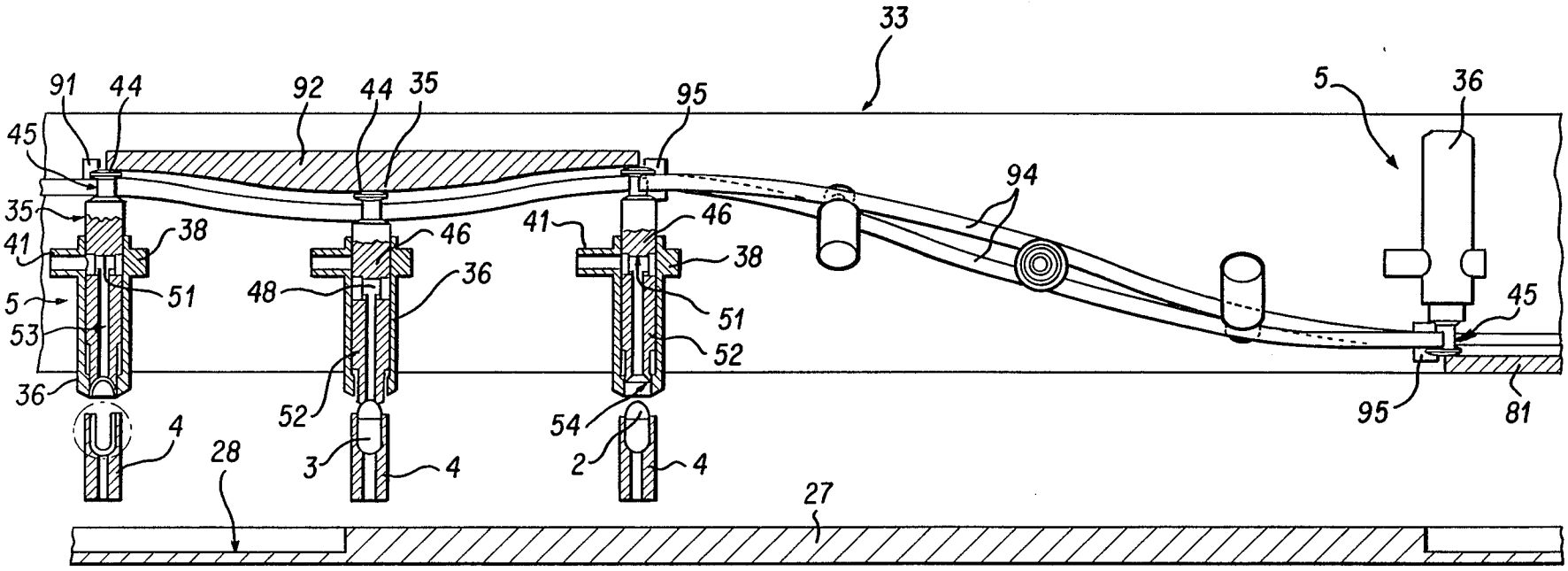
Figure 5B:
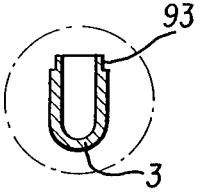

The annular body 33 is formed integrally with the plate 32 and supports a series of cams illustrated in FIG. 1 not respecting their relative position but in such a way as to favour, according also to FIGS. 4 and 5, comprehension of th rotation effected by the devices 5 about their respective pivot axes with the said forks. The body 33 has on its outer side wall an annular groove in correspondence with which all the devices 5 are located. In correspondence with this groove in the body 33 there are formed recesses for fixedly housing the cams which will be described hereinbelow.

In the right hand part of FIG. 5 a device 5 is illustrated in vertical position with the head 44 lowermost and within a cam 81 which is rectilinear in plan development. The cam 81 is fixed rigidly (FIG. 1) to the lower part of the body 33. In this position the seat 54 faces towards the opening 9 of the hopper. The cam 81, as all the other cams which will be described, has a slot in which the head 44 of the piston 35 is engageable. The disc 16 draws the device 5 into rotation about the machine axis and the device 5, during its passage along the cam 81, collects a cover 2. This latter is already orientated within the opening 9 of the hopper, as illustrated in FIG. 1, that is to say with its concavity facing upwardly. When the device 5 passes under the opening 9 of the hopper the cover 2 is sucked towards the seat 54 and retained there in that the hole 53 which opens into the seat 54 is in depression because of its pneumatic connection with the suction system. At the end of the cam 81 (FIG. 4) the device 5 passes from a vertical position to a horizontal position with the seat 54 facing outwardly. The rotation through 90° of the device 5, about the axis of the projections 38 and 41, is imposed by the engagement in the groove 45 of the piston 35 of two strands 82 having a single twist. The two ends of the strands 82 are fixed for example by welding to a respective bracket 83 one fixed to the body 33 at the output of the cam 81 and the second fixed to the body 33 at the input of a cam 84 (FIG. 1) carried fixedly at the centre of its groove by the body 33. The angular separation between the two brackets 83 is substantially 45° so that on the basis of this angular separation and because of the twist between the strands 82 a rotation through 90° of the device 5 about the axis of the projections 38 and 41 takes place. The brackets 83 like those which will be described hereinbelow are C-shape in such a way as to be traversed by the head 44. The ends of the strands 82 are welded to the ends of the arms of the brackets 83 in such a way that, upon arrival into the bracket 83 of the head 44, the groove 45 of the piston 35 is engaged by opposite parts of the strands 82.

Figure 3:
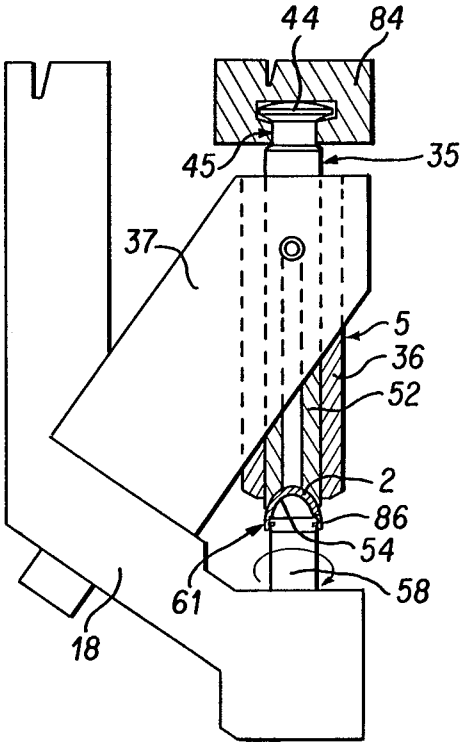
FIGS. 2 and 3 are, respectively, a sectional view and a side view of a detail of the machine of FIG. 1.

When the horizontal position has been reached the device 5 is maintained in this position by the engagement of the head 44 of the piston 35 in the cam 84 which in a plane frontal development is rectilinear whilst in plan it has a curvilinear profile such as to cause a translation of the piston 35 along the cylinder 36. During the first part of the cam 84 the piston 35 causes the seat 54 to project out of the cylinder 36, whilst in the second part the piston 35 retracts until it assumes the starting position. During this temporary projection from the seat 54 the cover 2, or rather its inner edge 86 of reduced thickness, is engaged (FIGS. 2 and 3) by the end of the respective cylinder 58 which rotates about the shaft 7 in phase with the corresponding device 5. Before this engagement the annular groove 61 has already received droplets of the said liquid from the needle 74. Moreover, the device 6 passes beneath the plate 65 so that compressed air from the source 71 arrives within the device 6 which causes rotation of the shaft 57 and therefore of the cylinder 58. This rotation causes a uniform distribution of the liquid around the groove 61 and the discharge of excess liquid towards the bottom of the body 72 from where, by means of a duct 87, it is withdrawn and sent by known means towards a reservoir, not illustrated for simplicity. The engagement of the rim 86 of the cover 2 by the end of the cylinder 58 causes a moistening of this.

At the end of the cam 84 a rotation through 90° is impressed on the device 5 in such a way as to cause it to pass into a vertical position with the seat 54 facing downwardly. This rotation takes place by engagement of two further strands 88 into the groove 45 of the piston 35, the strands 88 being supported by two brackets 91, one fixed to the body 33 at the end of the cam 84 and the other fixed to the body 33 at the beginning of a cam 92 fixed to an upper part of the body 33. In this case too, because the strands 88 have a single twist and because the angular separation between the brackets 91 is 45°, a rotation through 90° of the device 5 takes place about the axis of the projections 38 and 41. The cam 92 is curvilinear in a flat frontal development, in such a way as to cause a translation of the piston 35 along the cylinder 36 in a similar manner to that caused by the cam 84; but in this case the translation is in a vertical plane. The cover 2 is therfore found outside the cylinder 36 and inside a socket 4 in which a base 3 is housed wiith its rim 93 of reduced thickness oriented in such a way as to be able to be received within the rim 86 of the cover 2. In correspondence with the maximum outward extension from the cylinder 36 of the piston 35 the suction is removed from the interior of this and therefore the cover 2 remains within the interior of the socket 4 sealed onto the base 3. The cover 2 and the base 3 are made of amide and the said liquid is based on alcohol and water so that once the moistened rim 86 of the cover 2 is engaged by the rim 93 of the base 3 wetting of the amide and therefore a fusion of the rims 86 and 93 takes place and consequently a perfect sealing between the cover 2 and the base 3 is achieved. As illustrated in FIG. 5, the suction is removed from the interior of the piston 35 when the slot 28 terminates, that is to say the hole 21 corresponding to the piston 35 has its lower opening occluded and is therefore no longer in communication with the suction system. Subsequently the conveyor belt conveys the capsule thus formed towards a machine which expels it from the socket 4 and sends it on towards a packaging machine.

From the vertical position with the seat 54 facing downwards the device 5 is turned through 180° about the axis of the projections 38 and 41, that is back to a vertical position with the seat 54 facing upwardly. This rotation is imposed on the device 5 by two strands 94 which engage the groove 45 of the piston 35. The strands 94 have a double twist and are fixed at their ends to two brackets 95 similar to the brackets 91. One bracket 95 is fixed to the body 33 at the end of the cam 92 whilst the second is fixed to the body 33 at the beginning of the cam 81. The angular separation between the brackets 95 is substantially 90° so that because of the double twist of the strands 94 this causes the 180° rotation of the device 5 about the projections 38 and 41. In correspondence with the cam 81 the hole 21 is under depresion, via the slot 28. In its rotation about the machine axis the device 5 can therefore initiate a new working cylce.

From what has been described the numerous advantages achieved with the embodiment of the present invention will be evident.

In particular, orientation of the covers 2, moistening of these, and their sealing onto bases 3 is achieved in a single machine. With the machine 1 it is therefore not necessary to have a machine which separates a cover from its base because the covers and bases are supplied separately to the machine group. All this causes a distinctly lower cost for the group and facilitates the operations in that it is no longer necessary to close the base with the cover from which it had previously been separated. Moreover it is possible to utilise covers and bases even if their rims are not perfectly complementary in that these rims are then fused together by the moistening. With the machine 1 it is moreover possible to utilise amide for the production of the covers 2 and the bases 3, which is not possible with current machines which provide for a force-fit closure.

Finally, it is clear that the machine 1 described and illustrated here can have modifications and variations introduced thereto without by this departing from the protective ambit of the present invention.

In particular the plate 65 can be more or less extended according to the period which is prearranged for maintaining the spindle 57 and therefore the cylinder 58 in rotation. In fact, it is possible to maintain the spindle 57 in rotation only while the cylinder 58 traverses the body 72, that is to say as the groove 61 is receiving the droplets of liquid from the needle 74, or else it is possible to maintain the spindle 57 in rotation also during the phase of moistening the rim 86 of the cover 2. Moreover, it is possible that the device 6 be disposed in a different position from that illustrated, that is to say horizontal. By modifying the disc 16 it is possible to dispose the device 6 in a vertical position to moisten the cover 2 when the device 5 is in a vertical position if only by means of a cam similar to the cam 92. Moreover the device 5 can be shaped differently from that illustrated whilst retaining the principle of withdrawing the cover 2 from the opening 9, subsequently carrying this cover 2 to a position facing the device 6, and finally carrying the same cover 2 for sealing onto a base 3. In place of the conveyor belt the base 3 could be retained along the outer wall of a rotating part of the machine 1 by a suction opening able to take this base 3 from a supply machine and able to release the already-sealed base 3 to the cover 2 to a packaging machine. It is also possible that the sealing could take place in a machine adjacent to the machine 1. In fact, if the cover 2 once moistened is released by the device 5 to a suction opening formed on a rotating part of the machine 1, this opening can subsequently release the already-moistened cover 2 to a subsequent machine in which sealing takes place. The number of devices 5 can be chosen in dependence on the diametral dimensions of the machine 1 or on the basis of a predetermined production rate. In any case each device 5 has an associated device 6 and a hole 21. It is evident that the machine 1 can be utilised also for sealing covers and bases filled with products other than pharmaceuticals and made with materials different from amide, nevertheless utilising a comestible sealing liquid.

I claim:

1. A machine for moistening a cover (2) to be fixed to a base (3) filled for example with a pharmaceutical product, characterized by the fact that it comprises first means (5) rotatable about a machine axis and operable to take the said cover (2) from an opening (9) in a supply hopper, and second means (6) operable to moisten a rim (86) of the said cover (2) carried by the said first means (5), with a liquid which permits sealing of the said cover (2) onto the said base (3), the said first means comprising a plurality of first devices (5) carried by a first disc (16) rotating about the machine axis and rotatable by the cooperation of cams carried by a fixed body (33) about a respective transverse axis; and the said second means comprising a plurality of second devices (6) carried by the said first disc (16) and equal in number to the said first devices (5) in such a way that each of these latter has a respective associated said second device (6).

2. A machine for moistening a cover (2) of a capsule for pharmaceutical products, comprising a supply hopper for said covers (2), the supply hopper having an outlet opening (9); withdrawal means to withdraw the covers (2) from the supply hopper through said opening (9); and moistening means to moisten, with a sealing liquid, a rim of each cover (2) on the wihdrawal means (5); the withdrawal means comprising a first disc (16) having a first axis, and mounted for rotation about both said first and a transverse second axis, and a plurality of withdrawal devices (5) carried by the first disc (16); and said moistening means comprising a plurality of moistening devices (6) carried by said first disc (16), and each said moistening device (6) being associated to a respective withdrawal device (5).

3. A machine as claim in claim 2, wherein the withdrawal means further comprising a fixed body (33), and cam means mounted on said fixed body (33) and cooperating with the first disc (16) to rotate the same about the second axis.

4. A machine according to claim 3, wherein each moistening device (6) comprises a hollow cylinder (55) carried by said first disc (16), a source (71) of compressed air for feeding compressed air into the hollow cylinder (55), and a spindle (57) mounted with the hollow cylinder (55) and rotated, in use, about a longitudinal axis by the compressed air fed by said source (71); one end portion (58) of the spindle (57) projecting from said hollow cylinder (55) and being provided with an annular groove (61), into which said liquid is fed, and which is arranged, in use within said cover (2) to moisten said rim (86) with said liquid.

5. A machine according to claim 3, further comprising a first fixed plate (65) shaped as a circumferential sector coaxial with said first disc (16); two internal channels (66, 67) being provided in said first fixed plate (65); two coaxial radial holes (62, 63) being provided for communication of the compressed air source (71) with the interior of said cylinder (55) via said two internal channels (66, 67), a first of said holes being formed in said cylinder (55), and a second of said holes being formed at a portion (18) of said first disc (16) facing said channels (66, 67); and a seat (24) for said moistening device (6) being provided at said portion (18) of the first disc (16).

6. A machine according to claim 5, wherein the longitudinal axis of said spindle (57) is a horizontal axis.

7. A machine according to claims 5 or 6, further comprising a substantially C-shaped second fixed plate (72) having a longitudinal axis extending along an arc of a circle coaxial with said first disc (16) so as to allow the end portions (58) of said spindles (57) to move therethrough during rotation of the first disc (16) about the first axis; a supply needle (74) being mounted on said second plate (72), and a metering pump (75) for said liquid being connected to the supply needle (74) to feed said annular groove (61) with droplets of said liquid.

8. A machine according to claim 7, wherein each said withdrawal device (5) comprises a fork having two arms (37) and fixedly connected to said first disc (16); a sleeve (36) having a transverse axis and extending between said arms (37) for rotation about said transverse axis; and a piston (35) having a head (44) cooperating with said cam means carried by said fixed body (33), and mounted with said sleeve (36) for axial movement therealong; a seat (54) for receiving said cover (2) being provided on an axial end of said piston (35) opposite to said head (44).

9. A machine according to claim 8, wherein said piston (35) comprises an end portion (52) in which an axial hole (53) is formed communicating with said seat (54) for receiving said cover (2), and with an air suction system (22) which allows said cover (2) to be sucked from the opening (9) of said hopper, and to be held within said seat (54) of said piston (35).

10. A machine according to claim 9 further comprising a rotating shaft (7), a longitudinal axis of which is coaxial with said first axis, said shaft (7) being fixed to said first disc (16) and being provided with a plurality of radial holes (21), each of which is in constant pneumatic communication, by means of a respective duct (23), and said axial hole (53) of a corresponding said piston (35), and each of which, during each rotation of the said first disc (16), enters into pneumatic communication with said suction system (22) for a limited period corresponding to the withdrawal of said cover (2) from said opening (9) and its retention in said seat (54) of said piston (35) for effecting said moistening.

11. A machine according to claim 10 further comprising a fixed shaft (26) installed coaxially within said rotating shaft (7); an upper portion of said fixed shaft extending outside the rotating shaft (7) and coaxially supporting a second fixed disc (27) within which a channel is formed for pneumatic communication of said radial holes (21) of the said first disc (16) with said air suction system for a limited period; said upper portion of the fixed shaft (26) coaxially support said fixed body (33) which is annular in shape.

12. A machine according to claim 11, wherein said fixed body (33) supports:

a first cam (81) cooperating with said head (44) of said piston (35) for maintaining said piston (35) in a vertical position with the seat (54) of said piston (35) facing upwardly and towards the opening (9) from which said cover (2) is sucked into said seat (54);

a first member (82) for rotating said withdrawal device (5) through 90° about its pivot axis with the associated said fork to present seat (54) of said piston (35) facing radially outwardly;

a second cam (84) maintaining said withdrawal device (5) in a horizontal position for a predetermined time, and causing the seat (54) of said piston (35) to project temporarily from said sleeve (36) and the end portion (58) of said rotating spindle (57) to enter said cover (2) to moisten the rim (86) thereof;

a second member (88) for rotating said withdrawal device (5) through 90° about its pivot axis with the associated said fork to present said piston (35) in a vertical position with its seat (54) facing downwardly;

a third cam (92) maintaining said withdrawal device (5) in a vertical position for a predetermined time, and causing the seat (54) to project temporarily from said sleeve (36), and said cover (2) to engage and be released within, a socket (4) of a conveyor belt, within which a base (3) for said cover (2) is already lodged; and a third member (94) rotating said withdrawal device (5) through 180° about its pivot axis with the associated forks to present said piston (35) in a vertical positon with its seat (54) facing upwardly for withdrawal of a further cover (2).

13. A machine according to claim 12, wherein said members comprise respective pairs of strands (82, 88, 94) engaging a groove (45) formed on the piston (35) close to the head (44) thereof; each pair of strands (82, 88, 94) being supported at their ends by brackets (83, 91, 95) carried by said fixed body (33) and angularly separated respectively by 45°, 45° and 90°, and the strands (82, 88) of said first and second members having a single twist, and the strands (94) of said third member having a double twist.

14. A machine according to claim 12, wherein an annular element (25) is provided, which is coaxial with said rotating shaft (7) and fixed thereto; said annular element (25) having an outer lateral surface which is shaped for engagement with said conveyor belt.

15. A machine according to claim 1, characterised by the fact that each of the said second devices includes a rotating spindle (57) freely mounted to the interior of a hollow cylinder (55) carried by the said first disc (16) and the interior of which is in communication with a source of compressed air (71) which causes rotation of the said spindle (57) one end (58) of which projects from the said cylinder (55) and has an annular groove (61) into which the said liquid is fed and which in an operating position is located within the interior of the said cover (2) for moistening the said rim (86) with the said liquid.

16. A machine according to claim 15, characterised by the fact that it includes a first fixed plate (65) which in plan describes a circumferential sector coaxial with the said first disc (16) and which in its interior has a channel (66 and 67) operable to put the said compresed air source (71) into communication with the interior of the said cylinder (55) by means of two coaxial holes (62 and 63) formed respectively radially in the said cylinder (55) and along a portion (18) of the said first disc (16) facing the said channels (66 and 67) and in which is formed a seat (24) for the said second device (6).

17. A machine according to claim 16, characterised by the fact that the longitudinal axis of the said spindle (57) is horizontal.

18. A machine according to claim 17, characterised by the fact that it includes a second fixed plate (72) the longitudinal axis of which in plan describes an arc of a circle coaxial with the said first disc (16), and which is substantially C-shape in such a way that its interior can be traversed during rotation about the machine axis by the said ends (58) of the said spindles (57); the said second plate (72) supporting a supply needle (74) which receives the said liquid by means of a metering pump (75) and which is able to allow droplets of the said liquid to fall from its end within the said second plate (72) onto the said end (58) of the said spindle (57) in correspondence with the said annular groove (61).

19. A machine according to claim 17, characterised by the fact that each of the said first devices comprises a sleeve (36) rotating about its transverse axis along which it is pivoted to two arms (37) of a fork fixedly carried by the said first disc (16); within the said sleeve (36) there being housed a piston (35) axially slidable by the cooperation of tis head (44) with the said cams carried by the said fixed body (33), and the said piston (35) having at its axial end, opposite to that where the said head (44) is formed, a seat (54) for receiving the said cover (2).

20. A machine according to claim 19, characterised by the fact that the said piston (35) has an end portion (52) in which is formed an axial hole (53) which opens into the said seat (54) for receiving the said cover (2) and which is in pneumatic communication with an air suction system (22) which permits the said cover (2) to be sucked from the said opening (9) of the said hopper and its retention in the said seat (54) of the said piston (35).

21. A machine according to claim 20, characterised by the fact that it includes a rotating shaft (7) the longitudinal axis of which represents the machine axis, and which is fixed to the said first disc (16) in which a plurality of radial holes (21) are formed each of which is in constant pneumatic communication, by means of a respective duct (23), with the said axial hole (53) of a corresponding said piston (35) and each of which, during each rotation of the said first disc (16), enters into pneumatic communication with the said suction system (22) for a limited period corresponding to the withdrawal of the said cover (2) from the said opening (9) and its retention in the said seat (54) of the said piston (35) for effecting the said moistening.

22. A machine according to claim 21, characterised by the fact that it includes a fixed shaft (26) installed coaxially within the said rotating shaft (7) and having an upper portion externally of this latter which coaxially supports a second fixed disc (27) within which is formed a channel (28 and 31) able to put the said radial holes (21) of the said first disc (16) into pneumatic communication with the said air suction system for a limited period; the said upper portion of the said fixed shaft (26) coaxially supporting the said fixed body (33) which has an annular form.

23. A machine according to claim 22, characterised by the fact that the said fixed body (33) supports:

a first cam (81) able to cooperate with the said head (44) of the said piston (35) for maintaining this latter in a vertical position with the said seat (54) of the said piston (35) facing upwardly, that is to say towards the said opening (9) from which the said cover (2) is sucked into the said seat (54);

a first member (82) operable to cause rotation through 90° of the said first device (5) about its pivot axis with the associated said fork in such a way as to present the said seat (54) of the said piston (35) facing radially outwardly;

a second cam (84) operable to maintain the said first device (5) in a horizontal position for a predetermined section and operable to control a temporary projection from the said sleeve (36) of the said seat (54) of the said piston (35) in such a way that the said end (58) of the said rotatating spindle (57) is within the said cover (2) to moisten the said rim (86);

a second member (88) operable to cause rotation through 90° of the said first device (5) about its pivot axis with the said fork in such a way as to present the said piston (35) in a vertical position with its seat (54) facing downwardly;

a third cam (92) operable to maintain the said first device (5) in a vertical position for a predetermined section and to control a temporary projection from the said sleeve (36) of the said seat (54) of the said piston (35) in such a way that the said cover (2) becomes received in a socket (4) of a conveyor belt within which the said base (3) is already lodged, where the said cover (2) seals the said base (3) and contemporaneously is disengaged from the said device (5) because of the temporary interruption of the pneumatic communication between the said suction system (22) and the said axial hole (53) of the said piston (35); and a third member (94) operable to cause a rotation through 180° of the said first device (5) about its pivot axis with the said forks in such a way as to present the said piston (35) in a vertical position with its seat (54) facing upwardly for initiating of a new withdrawal of a said cover (2).

24. A machine according to claim 23, characterised by the fact that the said members comprise respective pairs of strands (82, 88 and 94) operable to engage a groove (45) formed on the said piston (35) close to the said head (44); each pair of strands (82, 88 and 94) being supported at their ends by two brackets (83, 91 and 95) carried by the said fixed body (33) and angularly separated respectively by 45°, 45° and 90°, and the said strands (82 and 88) of the said first and second members having a single twist and the said strands (94) of the said third member having a double twist.

25. A machine according to claim 23, characterised by the fact that the said rotating shaft (7) is fixed to a coaxial annular element (25) the outer lateral surface of which is shaped in such a way as to be engageable with the said conveyor belt.

* * * * *